US012188657B2

(12) United States Patent
Kim et al.

(10) Patent No.: US 12,188,657 B2
(45) Date of Patent: Jan. 7, 2025

(54) GAS BURNER DEVICE AND COOKING APPARATUS HAVING THE SAME

(71) Applicant: Samsung Electronics Co., Ltd., Suwon-si (KR)

(72) Inventors: Byeongkyu Kim, Suwon-si (KR); Seongcheol Moon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 17/247,961

(22) Filed: Dec. 31, 2020

(65) Prior Publication Data

US 2021/0207799 A1 Jul. 8, 2021

(30) Foreign Application Priority Data

Jan. 2, 2020 (KR) ..... 10-2020-0000124

(51) Int. Cl.
*F23D 14/06* (2006.01)
*F23D 14/64* (2006.01)
*F24C 3/08* (2006.01)

(52) U.S. Cl.
CPC ..... *F23D 14/065* (2013.01); *F23D 14/64* (2013.01); *F24C 3/085* (2013.01); *F23D 2900/14062* (2013.01); *F23D 2900/14063* (2013.01)

(58) Field of Classification Search
None
See application file for complete search history.

(56) References Cited

U.S. PATENT DOCUMENTS 5,052,920 A * 10/1991 Warren ..... F23D 14/64 29/522.1
5,800,159 A 9/1998 Maughan et al.
6,035,846 A * 3/2000 Saleri ..... F23D 14/06 126/39 R
6,132,205 A * 10/2000 Harneit ..... F23D 14/06 431/278
6,537,065 B1 3/2003 Shirali et al.
7,614,877 B2 11/2009 McCrorey et al.
(Continued)

FOREIGN PATENT DOCUMENTS

CN 2791485 Y 6/2006
CN 102348932 A 2/2012
(Continued)

OTHER PUBLICATIONS

Machine Translation WO-2016145744-A1 (Year: 2024).*
(Continued)

*Primary Examiner* — Edelmira Bosques
*Assistant Examiner* — Deepak A Deean

(57) ABSTRACT

A gas burner device includes an orifice holder including an orifice. The gas burner device also includes a burner body. The burner body includes a venturi tube arranged to receive a gas from the orifice and a burner port discharging the gas supplied through the venturi tube. The venturi tube includes a venturi inlet through which the gas that is jetted from the orifice flows in. The venturi tube also includes a venturi outlet through which the gas flowing in through the venturi inlet is discharged. The venturi tube further includes an acceleration part including a smaller diameter than the venturi inlet and the venturi outlet and includes a cylindrical shape.

8 Claims, 11 Drawing Sheets

(56) References Cited

U.S. PATENT DOCUMENTS

| | | | | |
|---|---|---|---|---|
| 7,661,954 | B2 * | 2/2010 | Harneit | F23D 14/06 431/278 |
| 8,408,897 | B2 * | 4/2013 | Rossi | F23D 14/06 126/39 J |
| 8,973,569 | B2 * | 3/2015 | Padgett | F23D 14/06 126/39 R |
| 10,488,051 | B2 * | 11/2019 | Moon | F24C 3/022 |
| 11,098,892 | B2 * | 8/2021 | Gerdes | F24C 3/126 |
| 2007/0218414 | A1 * | 9/2007 | Harneit | F23D 14/06 431/278 |
| 2008/0241777 | A1 * | 10/2008 | Rossi | F23D 14/06 126/39 R |
| 2009/0047611 | A1 * | 2/2009 | Armanni | F23D 14/065 126/39 R |
| 2009/0162801 | A1 * | 6/2009 | McCrorey | F23D 14/06 431/12 |
| 2010/0206293 | A1 * | 8/2010 | Padgett | F23D 14/06 431/258 |
| 2010/0319677 | A1 * | 12/2010 | Lacche | F23D 14/06 126/39 E |
| 2011/0120445 | A1 * | 5/2011 | Armanni | F23D 14/06 126/39 E |
| 2011/0223551 | A1 * | 9/2011 | Super | F23D 14/64 431/354 |
| 2011/0232628 | A1 * | 9/2011 | Bettinzoli | F23D 14/58 126/39 E |
| 2015/0034070 | A1 | 2/2015 | Fogolin et al. | |
| 2015/0107577 | A1 | 4/2015 | Jeong et al. | |
| 2015/0345800 | A1 * | 12/2015 | Cabrera Botello | F24C 3/085 431/354 |
| 2017/0108226 | A1 * | 4/2017 | Moon | F24C 3/085 |
| 2018/0119947 | A1 * | 5/2018 | Serenellini | F23D 14/085 |
| 2020/0408402 | A1 * | 12/2020 | Gerdes | F24C 3/126 |

FOREIGN PATENT DOCUMENTS

| | | | | |
|---|---|---|---|---|
| EP | 0485645 | B1 | 3/1997 | |
| JP | 2004-317076 | A | 11/2004 | |
| KR | 100187030 | B1 | 3/1999 | |
| KR | 20020002130 | A | 1/2002 | |
| KR | 20060084291 | A | 7/2006 | |
| KR | 10-2010-0096180 | A | 9/2010 | |
| KR | 10-2017-0043756 | A | 4/2017 | |
| WO | WO-2016145744 | A1 * | 9/2016 | |
| WO | WO-2022162524 | A1 * | 8/2022 | F23D 14/06 |

OTHER PUBLICATIONS

International Search Report dated Apr. 1, 2021 in connection with International Patent Application No. PCT/KR2020/018884, 3 pages.

Office Action issued Jul. 25, 2024, in connection with Korean Patent Application No. 10-2020-0000124, 23 pages.

* cited by examiner

GAS BURNER DEVICE AND COOKING APPARATUS HAVING THE SAME

CROSS-REFERENCE TO RELATED APPLICATION

This application is based on and claims priority under 35 U. S. C. § 119 to Korean Patent Application No. 10-2020-0000124 filed on Jan. 2, 2020, the disclosure of which is incorporated herein by reference in its entirety.

BACKGROUND

1. Field

The disclosure relates to a gas burner and cooking apparatus having the gas burner device, and more particularly, to a gas burner device with enhanced structure and cooking apparatus having the gas burner device.

2. Discussion of Related Art

The cooking apparatus is a device that cooks food by heating, and is largely classified into a type that generates heat with electricity to heat food and a type that generates heat by burning gas to heat food.

The cooking apparatus equipped with a gas burner device may cook a food using gas as a fuel. The gas burner device jets out flame to heat a food container by burning the gas.

The gas burner device may generally use primary air and secondary air. Specifically, the primary air may be supplied to the gas burner device from the top or bottom of a cooktop to burn the gas, and the secondary air may be supplied from around the flames on the cooktop.

The gas burner device may include a venturi tube to supply the primary air along with the gas jetted from a nozzle, when the primary air is supplied to the gas burner device from the bottom side of the cooktop.

SUMMARY

The disclosure provides a gas burner device with better efficiency and a cooking apparatus having the gas burner device.

The disclosure also provides a gas burner device capable of restraining flames from going out by maintaining stability of the flames, and a cooking apparatus having the gas burner device.

In accordance with an aspect of the disclosure, a gas burner device includes an orifice holder including an orifice; and a burner body including a venturi tube arranged to receive a gas from the orifice and a burner port discharging the gas supplied through the venturi tube, wherein the venturi tube includes a venturi inlet through which the gas that is jetted from the orifice flows in, a venturi outlet through which the gas flowing in through the venturi inlet is discharged, and an acceleration part including a smaller diameter than the venturi inlet and the venturi outlet and including a cylindrical shape.

The acceleration part may be located closer to the venturi inlet than to the venturi outlet.

The venturi tube may include a diffuser located between the acceleration part and the venturi outlet.

The diffuser may be longer than the acceleration part.

The burner body may include a gas chamber guiding the gas that passed the venturi tube to the burner port, and a bottom side of the gas chamber may be located lower than a bottom surface of the burner port.

The gas chamber may be a shape of a sector with an arc corresponding to an outer circumferential surface of the burner body on which the burner port is arranged.

The venturi outlet may be arranged closer to a center of the gas chamber than to the arc.

The gas burner device may further include a burner cap covering a top side of the burner body, and the burner cap may include a guide projection configured to guide the gas discharged from the venturi outlet to the bottom side of the gas chamber.

The burner port may include a bead protruding at an end from which the gas is discharged and configured to guide the gas discharged upwards.

The bead may include a curved portion concavely formed.

In accordance with another aspect of the disclosure, a cooking apparatus includes a supporting plate; and a gas burner device mounted on the supporting plate, wherein the gas burner device includes a first burner arranged on the supporting plate and including a first burner port, and an orifice holder arranged under the supporting plate and including an orifice arranged to jet gas to the first burner, and wherein the first burner includes a first venturi inlet through which the gas that is jetted from the orifice flows in, a first venturi outlet through which the gas flowing in through the first venturi inlet is discharged, and a gas chamber configured to guide the gas discharged from the first venturi outlet to the first burner port, and is a shape of a sector with an arc corresponding to an outer circumferential surface of the first burner on which the first burner port is formed.

A bottom side of the gas chamber may be located lower than a bottom surface of the first burner port, and the first venturi outlet may be arranged closer to a center of the gas chamber than to the arc.

The first burner may include a guide projection configured to guide the gas discharged from the first venturi outlet to the bottom side of the gas chamber.

The first burner port may include a bead that protrudes from a bottom surface of an end from which the gas is discharged.

The gas burner device may further include a second burner arranged within the first burner and including a second burner port, and the first burner may include a venturi guide arranged to guide the gas jetted from the orifice to the second burner, and the venturi guide may include a branched chamber branched from a flow path in the venturi guide of the gas flowing to the second burner and linked to outside.

The first burner may include a first acceleration part located closer to the first venturi inlet than to the first venturi outlet and including a smaller diameter than the first venturi inlet, the venturi guide may include a venturi acceleration part including a smaller diameter than an inlet through which the gas jetted from the orifice flows in, and the second burner may include a second acceleration part including a smaller diameter than the venturi acceleration part.

The venturi guide may include a venturi diffuser guiding the gas that passed the venturi acceleration part to the second burner and including diameters increasing in a flowing direction of the gas.

An outlet of the venturi guide may be a larger diameter than an inlet of the second burner through which the gas flows in.

The first burner may include a first diffuser located between the first acceleration part and the first venturi outlet and including diameters increasing in a flowing direction of the gas, and the second burner may include a second diffuser having diameters increasing in a flowing direction of the gas from the second acceleration part.

In accordance with another aspect of the disclosure, a gas burner device includes an orifice holder including an orifice; and a burner body including a venturi tube arranged to receive a gas from the orifice and a burner port discharging the gas supplied through the venturi tube, wherein the venturi tube includes a venturi inlet through which the gas that is jetted from the orifice flows in, a venturi outlet through which the gas flowing in through the venturi inlet is discharged, and an acceleration part including a smaller diameter than the venturi inlet and the venturi outlet and including a cylindrical shape, and wherein the burner body comprises a gas chamber configured to guide the gas discharged from the venturi outlet to the burner port, and be a shape of a sector with an arc corresponding to an outer circumferential surface of the burner body on which the burner port is formed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
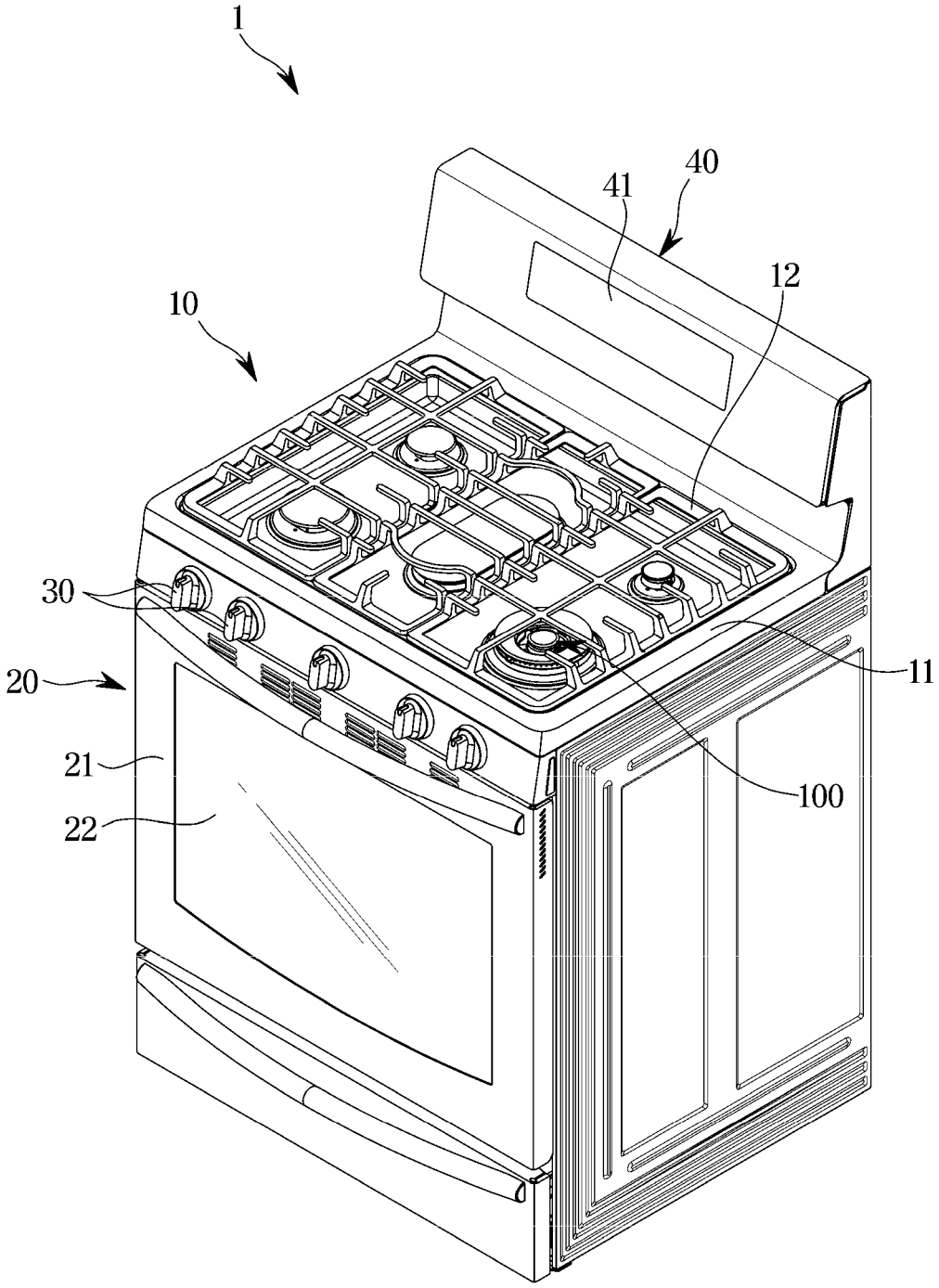
FIG. 1 illustrates a cooking apparatus, according to an embodiment of the disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "and/or," or the like.

The terms "front", "rear", "upper", "lower", "top", and "bottom" as herein used are defined with respect to the drawings, but the terms may not restrict the shape and position of the respective components.

Reference will now be made in detail to embodiments of the disclosure, which are illustrated in the accompanying drawings, wherein like reference numerals refer to the like elements throughout.

FIG. 1 illustrates a cooking apparatus, according to an embodiment of the disclosure.

Referring to FIG. 1, a cooking apparatus 1 may include an oven 20 and a cooktop 10. The cooktop 10 may be placed in an upper portion of the cooking apparatus 1, and the oven 20 may be placed in a lower portion of the cooking apparatus 1. A cavity (not shown) may be formed inside the oven 20. The cavity may receive an item to be cooked.

Although it is shown in FIG. 1 that the cooking apparatus 1 includes the cooktop 10 and the oven 20, the cooking apparatus 1 may include the cooktop 10 only in some other embodiments of the disclosure. That is, the cooking apparatus 1 may omit the oven 20. The cooking apparatus 1 may be provided in a built-in type or non-built-in type.

The cooktop 10 may include a gas burner device 100 for heating foods. The gas burner device 100 may use a gas as an energy source. The gas burner device 100 may generate heating power by burning the gas. Although it is shown in FIG. 1 that the cooktop 10 has five gas burner devices 100, there are no limitations on the number of gas burner devices. The gas burner device 100 will be described in detail later.

The cooktop 10 may include a supporting plate 11. The supporting plate 11 may define the top surface of the cooking apparatus 1. The gas burner device 100 may be mounted on the supporting plate 11.

A container support member 12 may be placed on the supporting plate 11. The container support member 12 may be formed for a cooking container (not shown) to be put thereon. The container support member 12 may be provided to be detachable from the supporting plate 11. The container support member 12 may be located above the gas burner device 100. There may be a plurality of container support members 12.

The oven 20 may be arranged under the cooktop 10. A plurality of racks (not shown) are provided inside the oven 20, and a tray may be hung on each rack. A food to be cooked may be put on the tray.

The oven 20 may include a door 21 to open or close the front side of the cavity. The door 21 may include a see-through part 22 made of a transparent or semitransparent material to allow a state that a food contained in the cavity is being cooked to be checked with naked eyes. The see-through part 22 may be formed with multiple glass layers. The multiple glass layers may be arranged with a certain gap between them for cooling air to flow through the gap.

Knobs 30 may be provided on atop front side of the cooking apparatus 1. The knobs 30 may serve to set functions of the cooktop 10 and/or the oven 20. The knobs 30 may be manipulated to operate each gas burner device 100. A user may set ON/OFF, temperature, timer, etc., by manipulating the knob 30. Although it is shown in FIG. 1 that there are five knobs 30, the number of knobs 30 is not limited thereto. There may be as many knobs 30 as the number of gas burner devices 100. Knobs 30 may control the respective gas burner devices 100 separately.

The cooking apparatus 1 may include a panel part 40. The panel part 40 may be formed to protrude from the top side of the cooktop 10. The panel part 40 may include a display 41 for displaying state information of the cooking apparatus 1 such as a temperature in a cooking chamber or a state of cooking. A controller (not shown) electrically connected to the display 41 and configured to control the cooking apparatus 1 may be arranged inside the panel part 40. Alternatively, the display 41 may be arranged near the knob 30.

Figure 2:
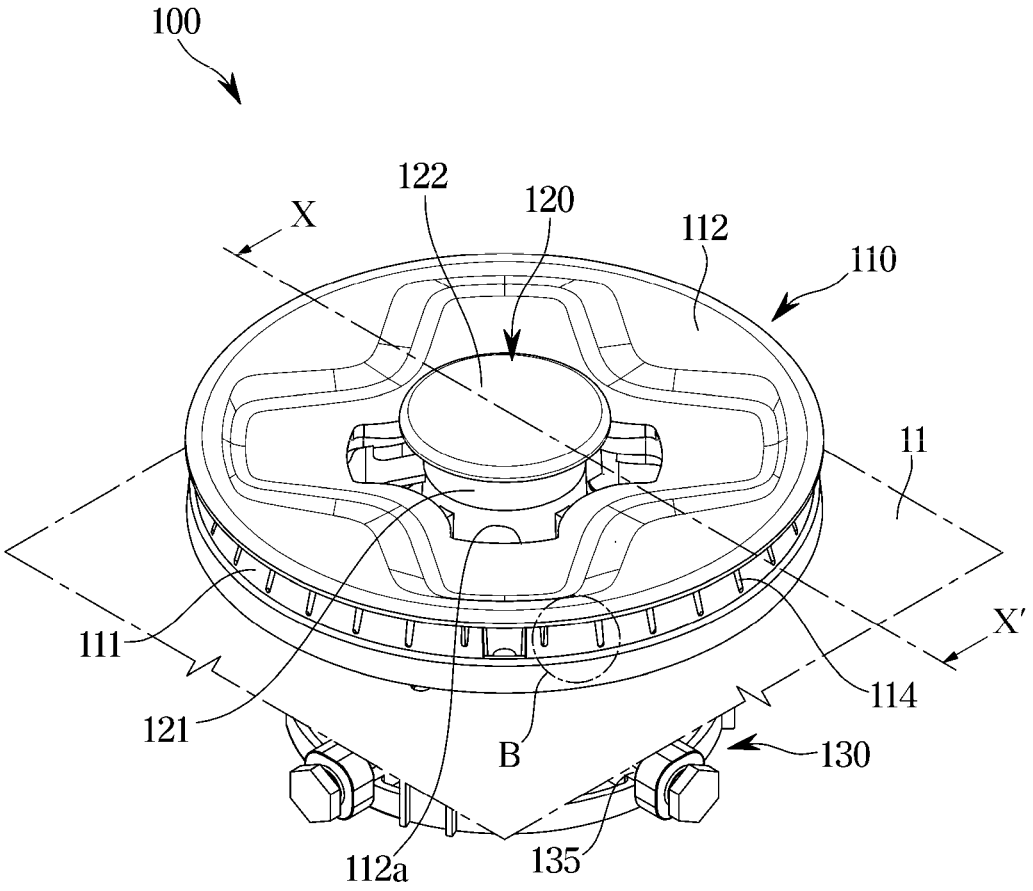
FIG. 2 illustrates a gas burner device shown in FIG. 1.
Figure 3:
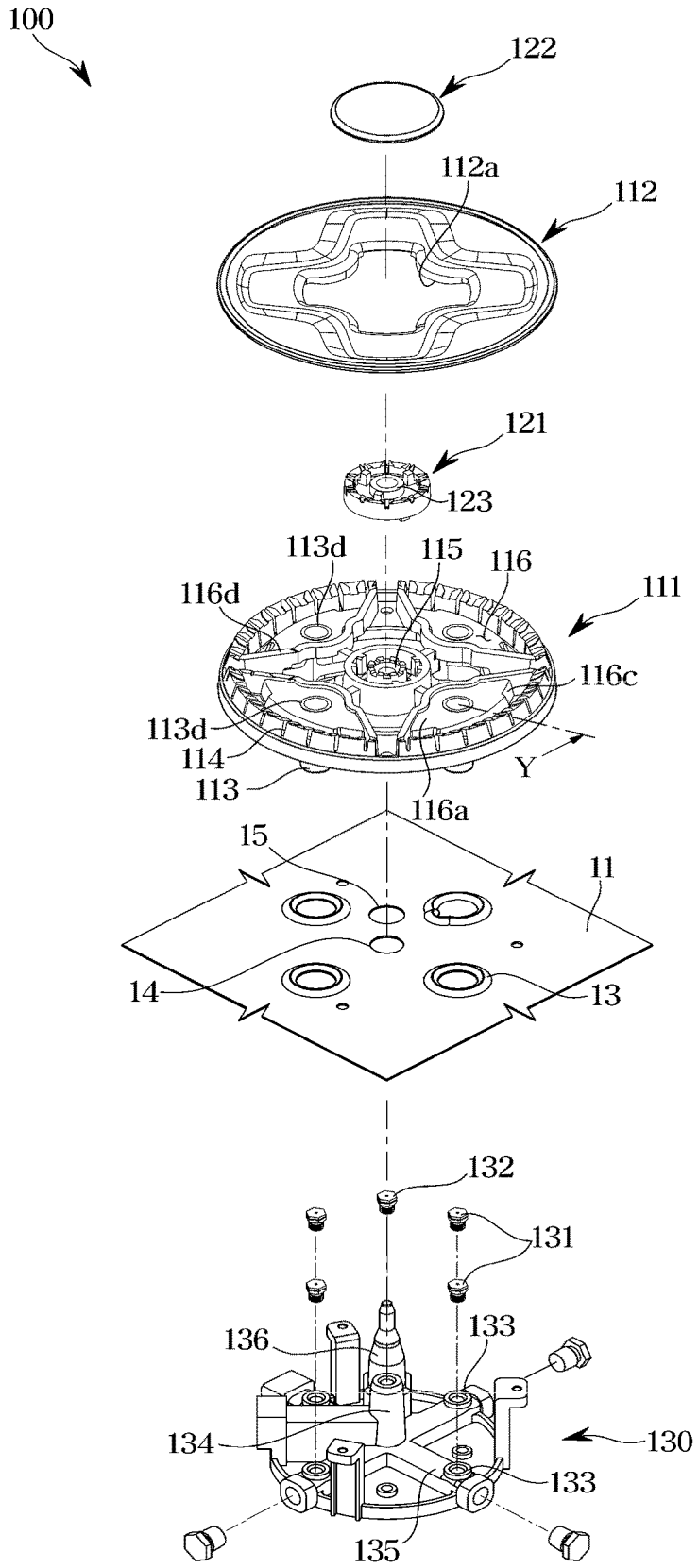
FIG. 3 illustrates an exploded view of the gas burner device shown in FIG. 2.
Figure 4:
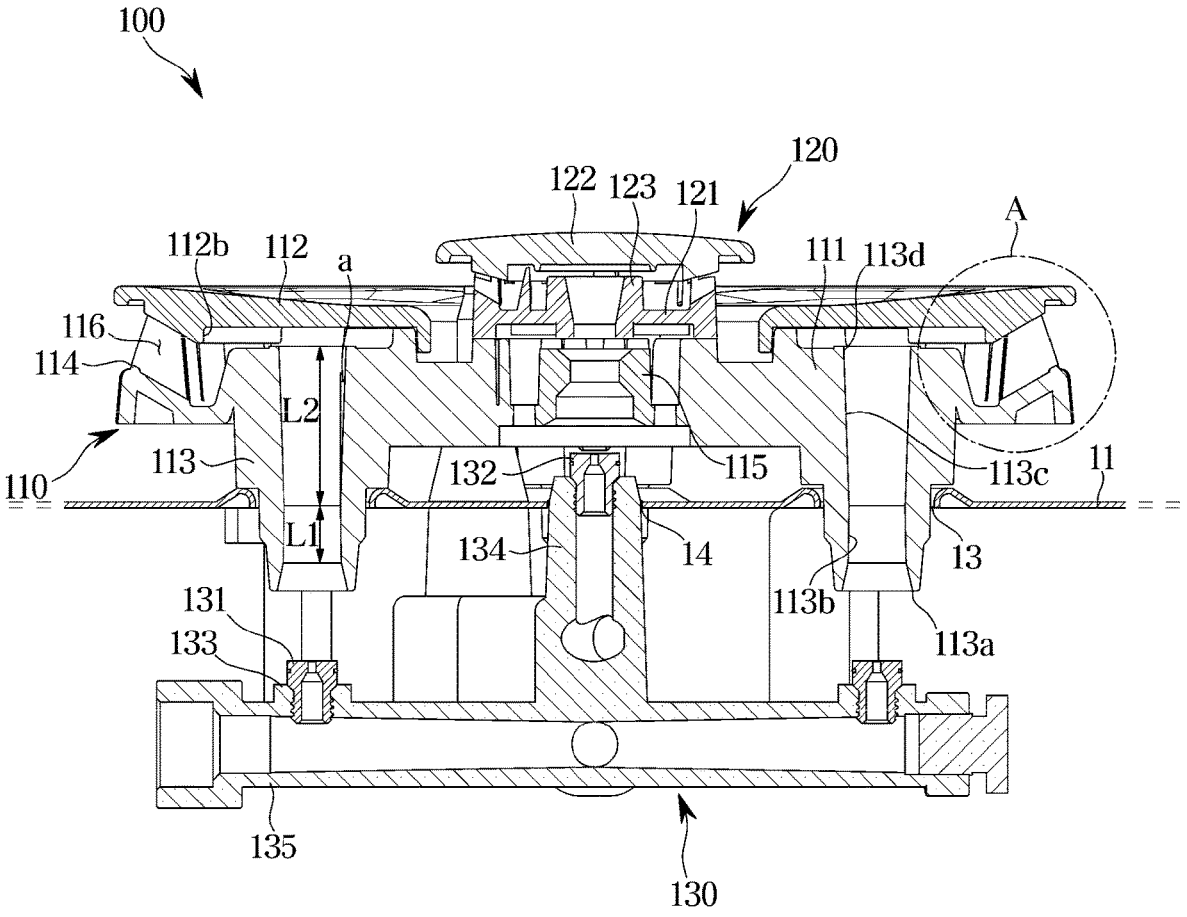
FIG. 4 illustrates a cross-sectional view of the gas burner device along line X-X' marked in FIG. 2.
Figure 5:
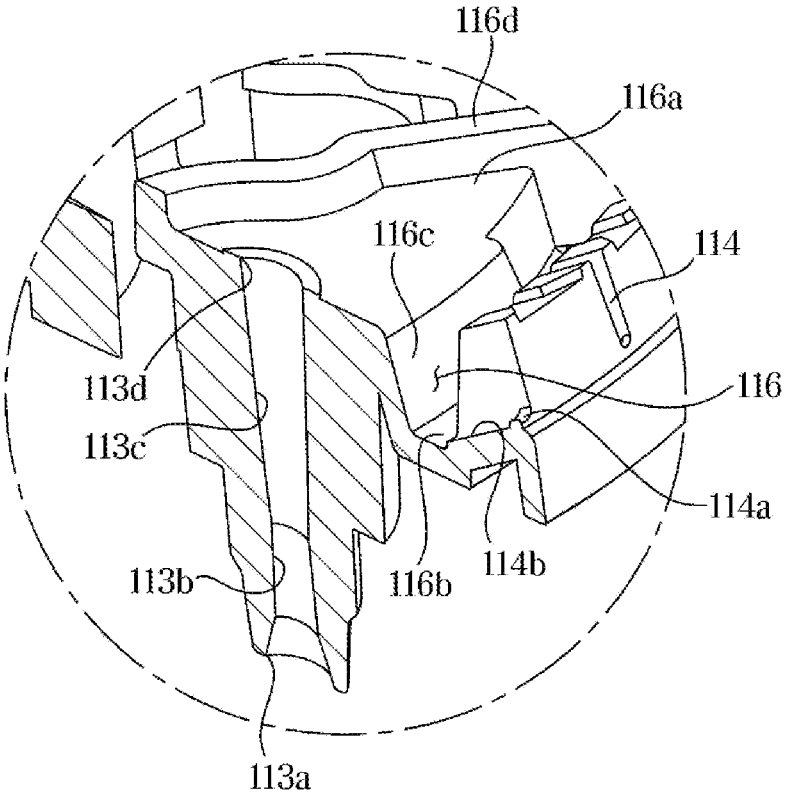
FIG. 5 illustrates a portion of a cross-section of a first burner along line Y marked in FIG. 3.
Figure 6:
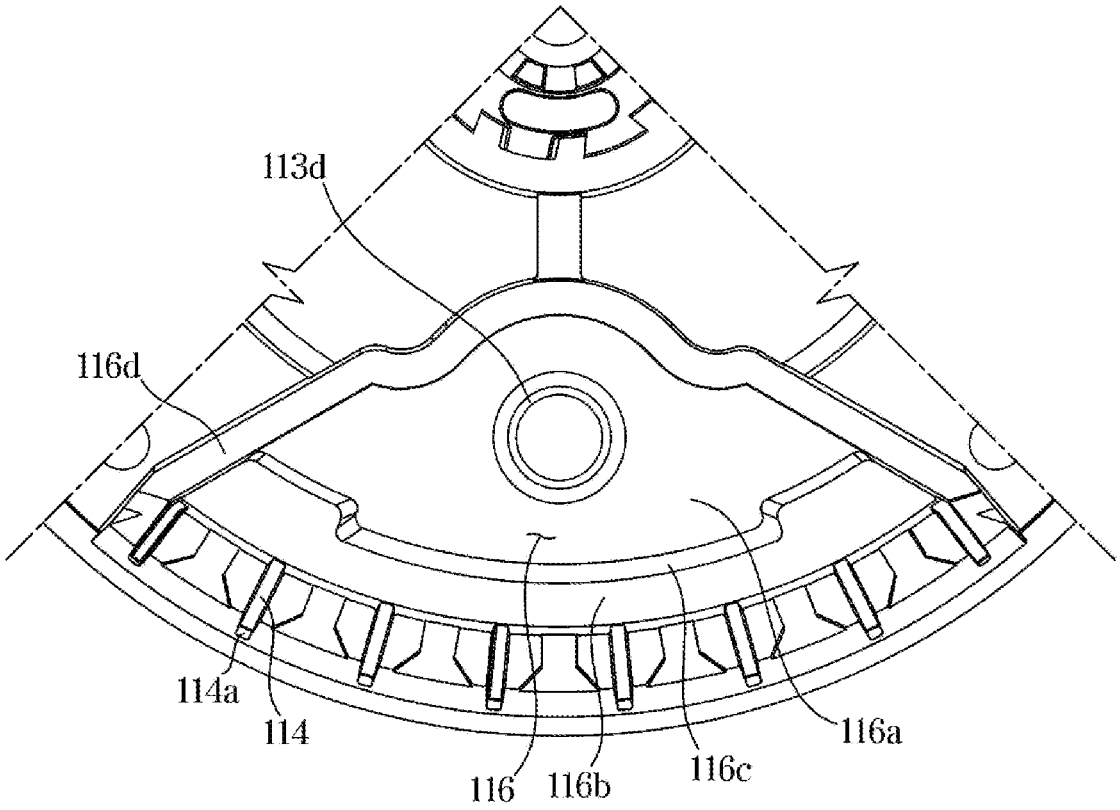
FIG. 6 illustrates a portion of the top surface of a burner body shown in FIG. 3.
Figure 7:
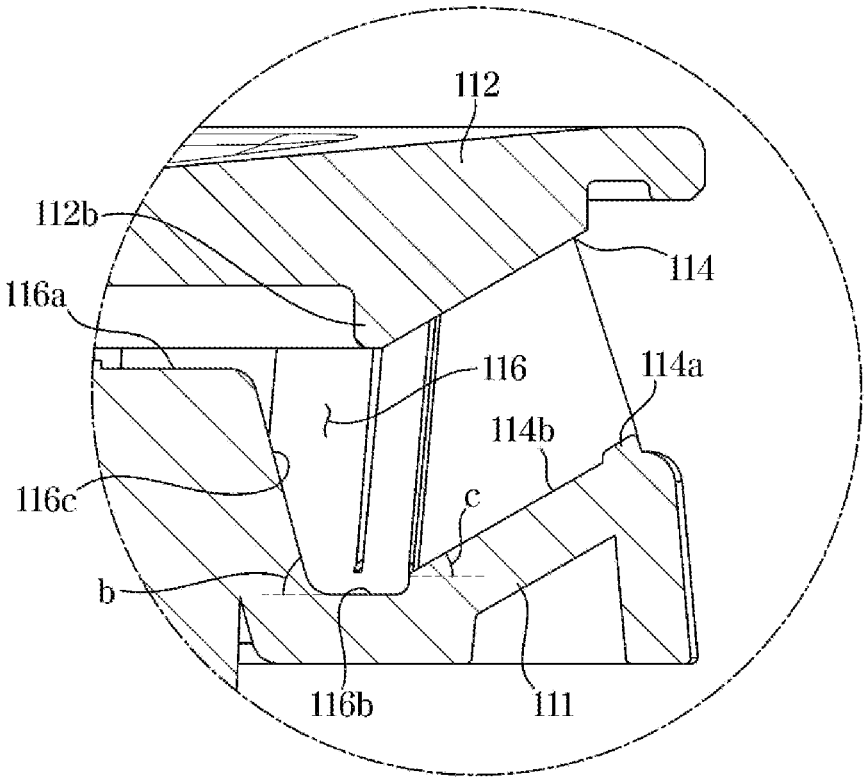
FIG. 7 illustrates an enlarged view of portion 'A' marked in FIG. 4.
Figure 8:
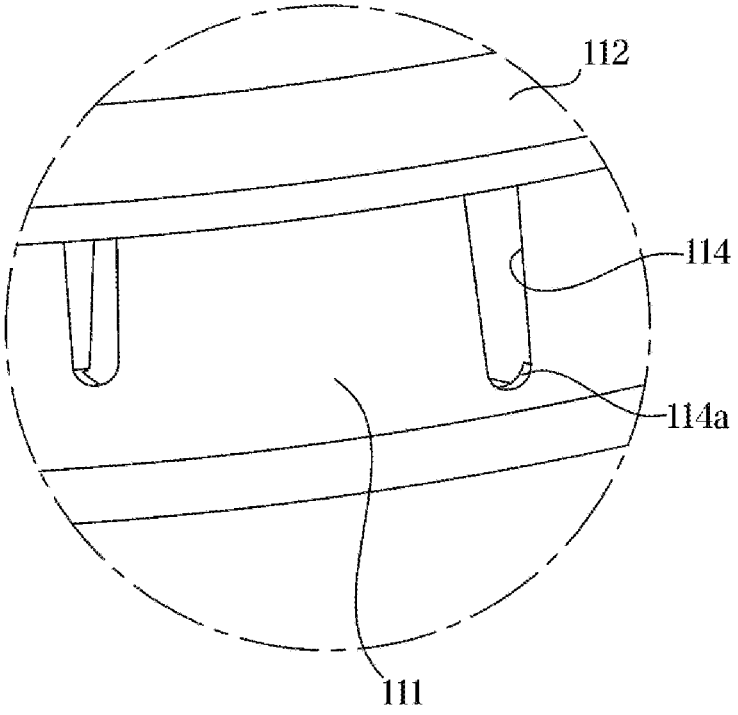
FIG. 8 illustrates an enlarged view of portion 'B' marked in FIG. 2.

FIG. 2 illustrates the gas burner shown in FIG. 1. FIG. 3 illustrates an exploded view of the gas burner shown in FIG. 2. FIG. 4 illustrates a cross-sectional view of the gas burner along line X-X' marked in FIG. 2. FIG. 5 illustrates a portion of a cross-section of a first burner along line Y marked in FIG. 3. FIG. 6 illustrates a portion of the top surface of a burner body shown in FIG. 3. FIG. 7 illustrates an enlarged view of portion 'A' marked in FIG. 4. FIG. 8 illustrates an enlarged view of portion 'B' marked in FIG. 2.

Referring to FIGS. 2 to 4, the gas burner device 100 in accordance with an embodiment of the disclosure will now be described. The gas burner device 100 may be mounted on the supporting plate 11. The supporting plate 11 may include a first through hole 13 formed for a portion of a first burner 110 of the gas burner device 100 to be inserted thereto. The supporting plate 11 may include a second through hole 14 formed for a portion of an orifice holder 130 of the gas burner device 100 to be inserted thereto.

The gas burner device 100 may include the first burner 110, a second burner 120, and the orifice holder 130. The first burner 110 may be arranged outside the second burner 120. The first burner 110 may be called an outer burner 110. The second burner 120 may be called an inner burner 120. The first burner 110 may provide relatively strong heating power. The second burner 120 may provide relatively weak heating power.

The orifice holder 130 may be detachably coupled to the bottom side of the supporting plate 11. The orifice holder 130 may include a first orifice 131 and a second orifice 132. Although it is shown in FIG. 3 that there are four first orifices 131 and one second orifice 132, the number of the first orifices 131 or second orifices 132 is not limited thereto.

The first orifice 131 may be provided to supply gas to the first burner 110. The first orifice 131 may be provided to supply the gas to a first venturi tube 113. The number of first orifices 131 may correspond to the number of first venturi tubes 113. The first orifice 131 may be arranged to match the first venturi tube 113. The orifice holder 130 may include a first orifice supporter 133 on which the first orifice 131 is mounted.

The second orifice 132 may be provided to supply gas to the second burner 120. The second orifice 132 may be provided to supply the gas to a second venturi tube 123 through a venturi guide 115. There may be as many second orifices 132 as the number of venturi guides 115. The second orifice 132 may be arranged to match the venturi guide 115. The orifice holder 130 may include a second orifice supporter 134 on which the second orifice 132 is mounted.

The orifice holder 130 may include a gas supply pipe 135 connected to a gas supply source (not shown) through a certain connection tube (not shown). The first orifice supporter 133 and the second orifice supporter 134 may protrude upwards from the gas supply pipe 135. The first orifice 131 and the second orifice 132 may be formed to be linked to the gas supply pipe 135.

The orifice holder 130 may include an ignition device 136. The ignition device 136 is arranged to ignite the gas burner device 100 by providing flames for the gas burner device 100. The ignition device 136 may extend through an ignition opening 15 of the supporting plate 11 up to the top of the supporting plate 11.

The first burner 110 may be settled on the top of the supporting plate 11. The first burner 110 may be arranged to produce flames with the gas supplied from the orifice holder 130. The first burner 110 may include a first burner body 111 and a first burner cap 112.

The first burner body 111 may be arranged to receive the gas from the first orifice 131. The first burner body 111 may be arranged to mix the gas supplied from the first orifice 131 with air. The first burner body 111 may be arranged to guide the mixture of the gas and the air to a first burner port 114 to produce flames. The first burner body 111 may have an almost circular shape.

The first burner body 111 may include a plurality of first venturi tubes 113. Although it is shown in FIG. 3 that there are four first venturi tubes 113, the number of the venturi tubes 113 is not limited thereto.

The first venturi tube 113 may protrude from the bottom side of the first burner body 111. The first venturi tube 113 may be formed to receive the gas from the first orifice 131. The first venturi tube 113 may be positioned to match the first orifice 131.

Referring to FIG. 4, the first venturi tube 113 may be arranged to supply primary air to the first burner 110 and mix the primary air with the gas. The first venturi tube 113 may include a first venturi inlet 113*a*, a first acceleration part 113*b*, a first diffuser 113*c*, and a first venturi outlet 113*d*. The gas jetted from the first orifice 131 flows into the first venturi tube 113 through the first venturi inlet 113*a*, accelerated while passing the first acceleration part 113*b*, mixed with air in the first diffuser 113*c*, and discharged from the first venturi tube 113 through the first venturi outlet 113*d*.

The gas jetted from the first orifice 131 may be mixed with air inside the first venturi tube 113. Specifically, the gas jetted from the first orifice 131 to the first venturi tube 113 may be accelerated while passing the first acceleration part 113*b*. As the gas is accelerated, negative pressure is created in the first venturi tube 113. Accordingly, the air around the first venturi inlet 113*a* is forced to flow into the first venturi tube 113. The air flowing into the first venturi tube 113 is mixed with the gas in the first diffuser 113*c*, and then may be used as the primary air required for combustion.

The first acceleration part 113*b* may have a small diameter as compared to the other portions of the first venturi tube 113. The first acceleration part 113*b* may be formed to accelerate a fluid passing the first acceleration part 113*b* according to the venturi effect. The first acceleration part 113*b* may have the shape of a cylinder. As the first acceleration part 113*b* has the shape of a cylinder, the gas passing the first venturi tube 113 may be accelerated. With the increase in jet speed of the gas in the first acceleration part 113*b*, straightness of flames may be improved.

In the meantime, the first acceleration part 113*b* may be fabricated in an injection molding method. The first acceleration part 113*b* may have a certain inclination angle to be easily separated from the mold.

The first acceleration part 113*b* may be located closer to the first venturi inlet 113*a* than to the first venturi outlet 113*d*. Otherwise, when the first acceleration part 113*b* is located closer to the first venturi outlet 113*d* than to the first venturi inlet 113*a*, negative pressure absorption force caused by the gas accelerated in the first acceleration part 113*b* and applied onto the first venturi inlet 113*a* is reduced due to gravity or resistance. In other words, as the first acceleration part 113*b* that accelerates gas is located closer to the first venturi inlet 113*a* than to the first venturi outlet 113*d*, a loss of the negative pressure absorption force caused by acceleration of the gas may be reduced, leading to application of larger absorption force onto the first venturi inlet 113*a*, and accordingly, causing more of the primary air to flow into the first burner 110.

As more of the primary air flows into the first burner 110, the cooking apparatus 1 may have better efficiency. Furthermore, with an increase in the amount of the primary air, the cooking apparatus 1 may have the better efficiency while remaining in the same size. In other words, the cooking apparatus 1 according to the embodiment of the disclosure may have the same efficiency as before at a relatively small size.

The first diffuser 113*c* may be arranged to mix the gas and the primary air that have passed the first acceleration part 113*b* and guide the gas and the primary air to a gas chamber 116. The first diffuser 113*c* may be arranged to minimize the loss from resistance of the gas and the primary air that are passing the first diffuser 113*c*. For this, the first diffuser 113*c* may have circular cross-sections having diameters increasing toward the first venturi outlet 113*d*. In this case, the inner circumferential surface of the first diffuser 113*c* may have an angle (a) of about 2 to 5 degrees from the vertical direction. The first diffuser 113*c* may have length L2, which may be two to four times longer than length (L1) of the first acceleration part 113*b*. With this structure, the first diffuser 113*c* may minimize the loss of the gas and the primary air that are passing the first diffuser 113*c*.

Referring to FIGS. 5 to 7, the first burner body 111 may include the gas chamber 116. The gas chamber 116 may mix the gas and air that have passed the first venturi tube 113, and discharge the mixture through the first burner port 114 at a certain rate. There may be as many gas chambers 116 as the number of venturi tubes 113.

The gas chamber 116 may be shaped substantially like a sector. The gas chambers 116 may be arranged at a certain distance from each other along the circumference of the first burner body 111. The gas chamber 116 may include a top surface 116*a*, a bottom surface 116*b*, a slope surface 116*c*, and a guide wall 116*d*.

The top surface 116*a* of the gas chamber 116 and a bottom surface of a first burner cap 112 may define a flow path that guides the gas and air discharged through the first venturi outlet 113*d*. The first venturi outlet 113*d* may be formed on the top surface 116*a* of the gas chamber 116. The first venturi outlet 113*d* may be at a higher level than the bottom surface 116*b* of the gas chamber 116. With the top surface 116*a* of the gas chamber 116, the first venturi tube 113 may secure as much length of the first diffuser 113*c* as possible.

Specifically, the gas accelerated in the first acceleration part 113*b* passes the first diffuser 113*c*. In this case, the longer the first diffuser 113*c*, the less the gas flow resistivity, which may prevent as much as possible the gas accelerated in the first acceleration part 113*b* from slowing down. Furthermore, as the gas passes the first diffuser 113*c* while remaining at a high rate, the amount of air flowing into the venturi tube 113 may increase.

In an embodiment of the disclosure, the cooking apparatus 1 may have more of the primary air flow into the first burner 110 as the gas chamber 116 includes the top surface 116*a* to secure the first diffuser 113*c* as long as possible at predefined height and the first venturi outlet 113*d* of the first venturi tube 113 is formed on the top surface 116*a* of the gas chamber 116.

The bottom surface 116*b* of the gas chamber 116 may be formed at a lower level than the bottom of the first burner port 114. As the bottom surface 116*b* is formed at a lower level than the bottom of the first burner port 114, the gas and air of the gas chamber 116 may be smoothly discharged through the first burner port 114. Furthermore, as the bottom surface 116*b* is formed at a lower level than the bottom of the first burner port 114, a backfire of flames may be prevented.

The slope surface 116*c* of the gas chamber 116 may be formed at a lower level than the bottom of the first burner port 114. The slope surface 116*c* may be formed at an angle (b) of about 60 to 80 degrees.

The guide wall 116*d* of the gas chamber 116 may substantially have a sector form. The guide wall 116*d* may guide a portion of the gas and air discharged from the first venturi outlet 113*d* toward the first burner port 114.

The first venturi outlet 113*d* may be arranged at a certain distance from the outer circumferential surface of the first burner body 111 on which the first burner port 114 is formed. The first venturi outlet 113*d* may be arranged close to the center of the gas chamber 116 substantially having the sector form. With the structure, the gas and air may be radially discharged from the first venturi outlet 113*d*, and a portion of the discharged gas and air may flow directly to the first burner port 114 while some other portions are guided by the guide wall 116*d* to the first burner port 114.

As the gas chamber 116 has the sector form, the flow resistivity of the gas passing the gas chamber 116 may decrease. With the decrease in the flow resistivity of the gas, the speed loss of the gas may be reduced, thereby increasing the amount of the primary air flowing into the first venturi tube 113.

The first burner cap 112 may cover a portion of the top side of the first burner body 111. The first burner cap 112 may be provided for the gas and air to be stored in the gas chamber 116. The first burner cap 112 may guide the gas and air jetted through the first burner port 114 to a certain direction. The first burner cap 112 may include a cap hole 112*a* formed for the second burner 120 to pass through.

The first burner cap 112 may include a guide projection 112*b* formed to protrude from the bottom surface of the first burner cap 112. The guide projection 112*b* may be formed to guide the gas and air that have passed the first venturi tube 113 and move to the gas chamber 116 to the bottom surface 116*b* of the gas chamber 116. As the gas and air flowing into the gas chamber 116 is guided to the bottom surface 116*b* of the gas chamber 116, the gas and air may pass by the the bottom surface 116*b* of the gas chamber 116 and may be discharged at a certain angle along the first burner port 114.

The first burner 110 may include at least one first burner port 114. The first burner port 114 may be formed when the first burner cap 112 is coupled to the first burner body 111. The first burner port 114 may be provided in the plural. The plurality of first burner ports 114 may be arranged along the outer circumferential surface of the first burner 110 at certain intervals. In this case, when the interval between the plurality of first burner ports 114 is narrow, flames produced from the plurality of first burner ports 114 may be merged, thereby hindering secondary air from being smoothly supplied to each of the first burner ports 114. This may cause longer flames and incomplete combustion like yellow tips, so a wide enough interval between the plurality of first burner ports 114 needs to be secured.

Referring to FIGS. 7 and 8, the first burner port 114 may be inclined upward. As the first burner port 114 is inclined upward, the angle of the flame may be raised, and accordingly, boiling time of the first burner 110 may be reduced. A bottom surface 114*b* of the first burner port 114 have an inclination angle of about 20 to 30 degrees.

A bead 114*a* may be formed at the first burner port 114 to further raise the flame angle. The bead 114*a* may be formed to protrude from the bottom side of an outer end of the first burner port 114. Flames released through the first burner port 114 may have an angle further raised by the bead 114*a*.

The outer end of the bottom surface 114*b* of the first burner port 114 may have a rounded form. Specifically, the bead 114*a* arranged at the first burner port 114 may have the rounded form. The bead 114*a* may include a curved portion.

With the structure of the first burner port 114, the gas burner device 100 may prevent flames from being lifted.

Figure 9:
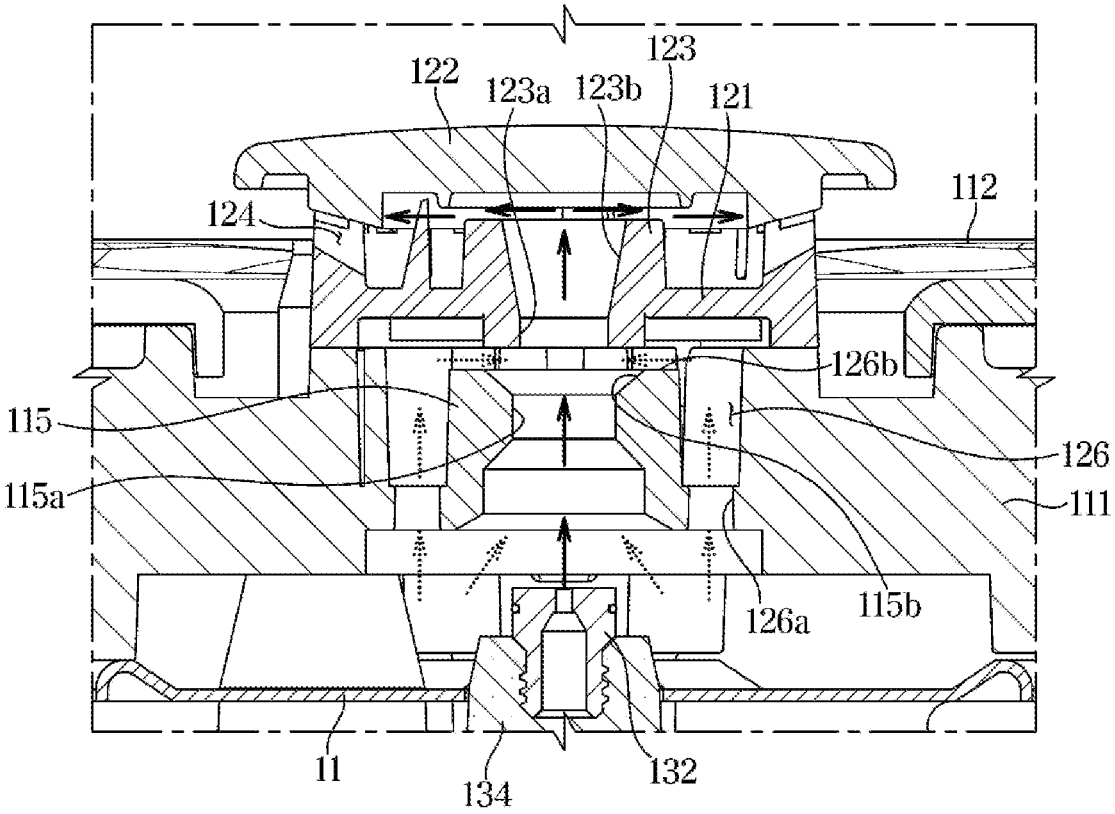
FIG. 9 illustrates an enlarged view of a portion of a cross-section of the gas burner device shown in FIG. 4, which shows flows of gas and primary air when the gas is supplied to a second burner.
Figure 10:
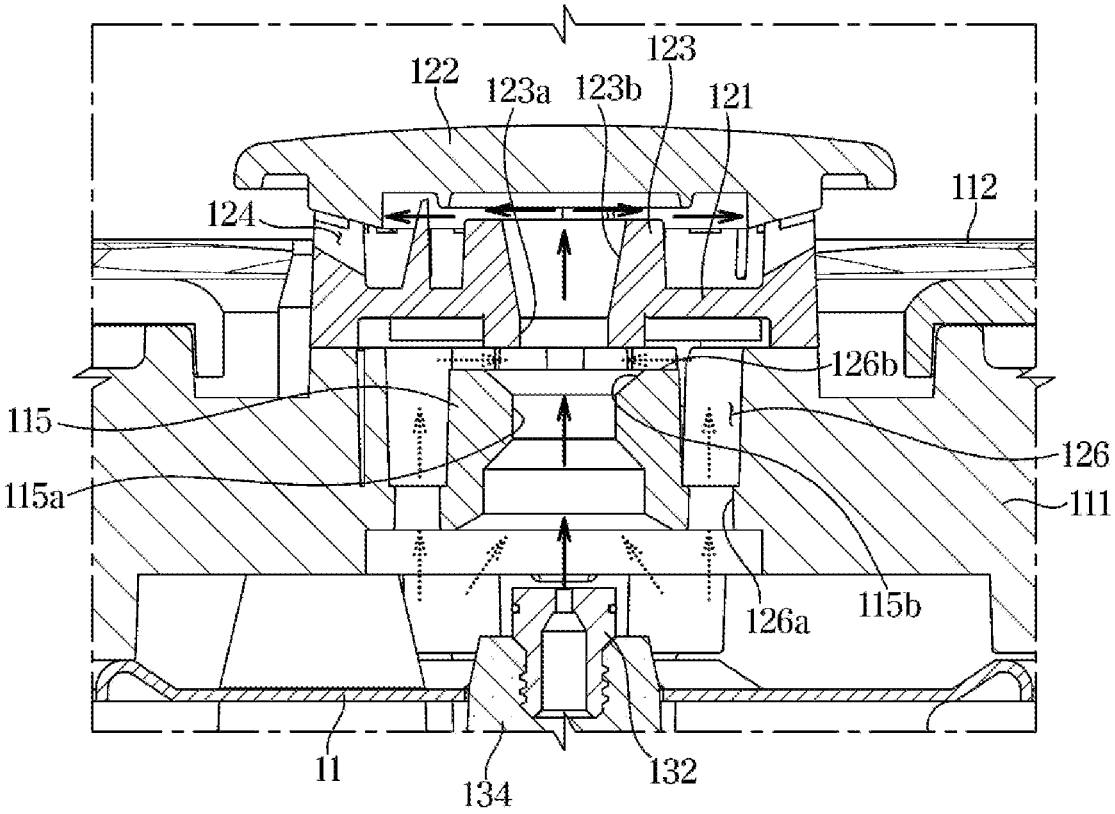
FIG. 10 illustrates a state in which the amount of gas supply is rapidly reduced in the gas burner device shown in FIG. 9.

FIG. 9 illustrates an enlarged view of a portion of a cross-section of the gas burner device shown in FIG. 4, which shows flows of gas and primary air when the gas is supplied to a second burner. FIG. 10 illustrates a state in which the amount of gas supply is rapidly reduced in the gas burner device shown in FIG. 9.

Referring to FIGS. 9 and 10, solid arrows represent gas flows, and dotted arrows represent air flows.

Referring to FIG. 9, the second burner 120 may be arranged within the first burner 110. The second burner 120 may be arranged to pass through the cap hole 112*a* of the first burner cap 112. The second burner 120 may include a second burner body 121 and a second burner cap 122. The second burner body 121 may have an almost circular shape. The second burner body 121 may be settled on the first burner 110. The second burner body 121 may be arranged to be linked to the venturi guide 115. The second burner body 121 may receive the gas jetted from the second orifice 132 through the venturi guide 115.

The venturi guide 115 may be arranged in the first burner body 111 of the first burner 110. The venturi guide 115 may be located in the center of the first burner body 111. The venturi guide 115 may be arranged to guide the gas jetted from the second orifice 132 to the second burner 120. The venturi guide 115 may include a venturi acceleration part 115*a*, a venturi diffuser 115*b*, and a branched chamber 126.

The venturi acceleration part 115*a* may have a small diameter as compared to the other portions of the venturi guide 115. The venturi acceleration part 115*a* may be formed to accelerate a fluid passing the venturi acceleration part 115*a* according to the venturi effect. As the fluid passing the venturi acceleration part 115*a* is accelerated, negative pressure is created around an inlet portion of the venturi acceleration part 115*a*, thereby forcing air to flow into the venturi guide 115.

The venturi diffuser 115*b* may mix the gas and air having passed the venturi acceleration part 115*a*. The venturi diffuser 115*b* may be inclined at least 15 degrees or more from the vertical direction. Accordingly, the air discharged from the venturi diffuser 115*b* may be widely spread toward the second venturi tube 123, and the amount of the air that collides with an inlet portion of the second venturi tube 123 and take a detour to the branched chamber 126 may increase.

The branched chamber 126 may be located farther out in the radial direction of the venturi acceleration part 115*a* and the venturi diffuser 115*b*. The branched chamber 126 may include a first chamber opening 126*a* formed at the inlet portion of the venturi guide 115. The first chamber opening 126*a* may be located farther out in the radial direction of the venturi guide 115. The branched chamber 126 may be linked to the outside via the first chamber opening 126*a*. The branched chamber 126 may define a second chamber opening 126*b* with the second burner body 121. The second chamber opening 126*b* may be formed between the venturi guide 115 and the second burner body 121. The second chamber opening 126*b* may be formed for the gas and air having passed the venturi guide 115 to be branched from the flow path to the second burner body 121 to the branched chamber 126.

The second burner body 121 may include the second venturi tube 123. The second venturi tube 123 may be provided to discharge the gas and air supplied from the venturi guide 115 toward a second burner port 124 so that the second burner 120 creates flames. The second venturi tube 123 may include a second acceleration part 123*a* and a second diffuser 123*b*.

The second acceleration part 123*a* may have a small diameter as compared to the other portions of the second venturi tube 123. The second acceleration part 123*a* may be located around an inlet portion of the second venturi tube 123. The second acceleration part 123*a* may be formed to accelerate a fluid passing the second venturi tube 123 according to the venturi effect. As the fluid passing the second acceleration part 123*a* is accelerated, negative pressure is created around an inlet portion of the second acceleration part 123*a*, thereby forcing air to flow into the second venturi tube 123 through the second chamber opening 126*b*.

The second diffuser 123*b* may mix the gas and air having passed the second acceleration part 123*a*.

The second acceleration part 123*a* may be smaller in diameter than the venturi acceleration part 115*a*. The second acceleration part 123*a* may have a small diameter as compared to an outlet portion of the venturi guide 115.

The second burner cap 122 may cover the top of the second burner body 121. The second burner cap 122 may be provided to store the gas and air supplied to the second burner 120. The second burner cap 122 may define the second burner port 124 with the second burner body 121.

The second burner 120 may include at least one second burner port 124. The second burner port 124 may be formed when the second burner cap 122 is coupled to the second burner body 121. When the plurality of second burner ports 124 are formed, the plurality of second burner ports 124 may be arranged along the outer circumferential surface of the second burner 120 at certain intervals.

Referring to FIG. 9, when a maximum amount of gas is supplied from the second orifice 132, outside air may be forced by the venturi acceleration part 115*a* of the venturi guide 115 and the second acceleration part 123*a* of the second venturi tube 123 to flow into the venturi acceleration part 115*a* and/or the branched chamber 126 and then supplied to the second burner 120.

In the meantime, when the amount of gas supplied from the second orifice 132 is rapidly reduced from the maximum to a minimum, as much outside air as when the maximum amount of gas is supplied instantaneously flows in, which may make the flames go out.

Referring to FIG. 10, in the gas burner device 100 according to an embodiment of the disclosure, when the amount of gas supplied from the second orifice 132 is rapidly reduced from the maximum to the minimum, the air moving from the venturi guide 115 to the second venturi tube 123 may collide with the inlet portion of the second venturi tube 123 and may be branched into the branched chamber 126 through the second chamber opening 126*b*. Specifically, as the outlet portion of the venturi guide 115 has a larger diameter than that of the inlet portion of the second venturi tube 123, a large amount of air moving from the venturi guide 115 to the second venturi tube 123 collides with the inlet portion of the second venturi tube 123 and thus moves to the branched chamber 126. The air and gas having moved to the branched chamber 126 may be discharged to the outside through the first chamber opening 126*a*.

Figure 11:
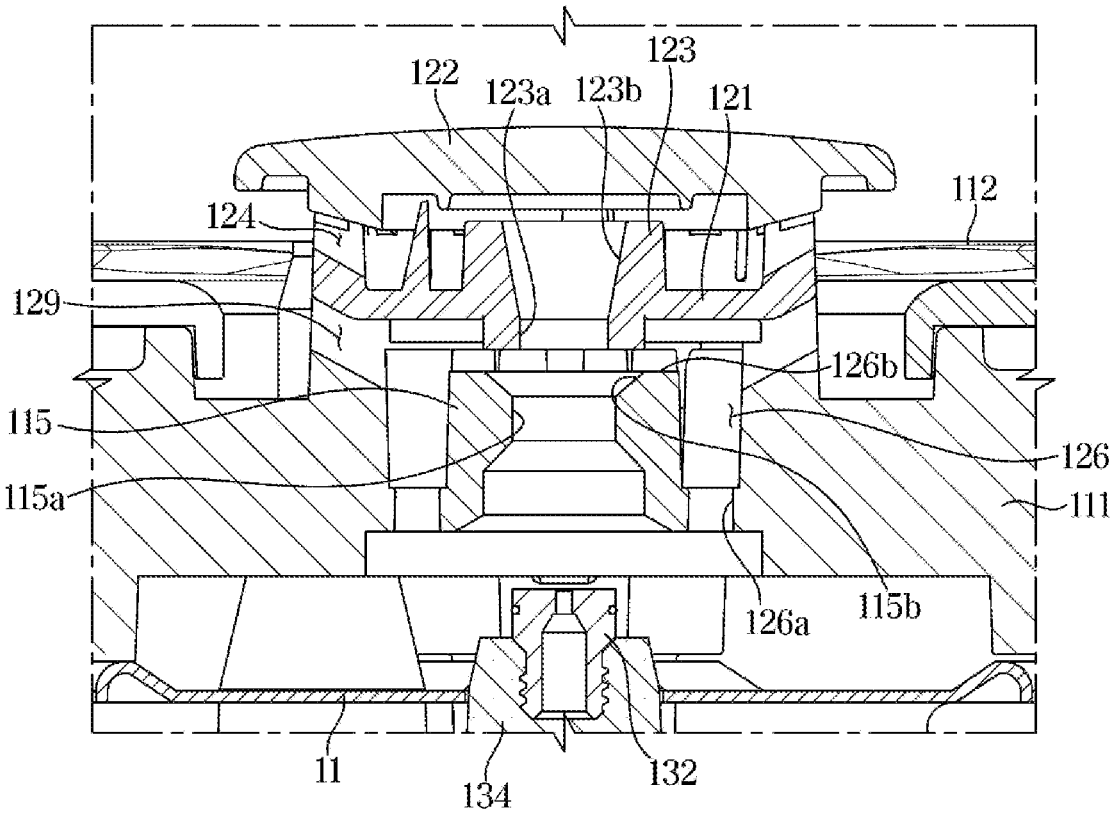
FIG. 11 illustrates a modified version of the gas burner device shown in FIGS. 9 and 10.

In this way, as a portion of the air moving from the venturi guide 115 to the second venturi tube 123 is discharged to the outside through the branched chamber 126, the gas burner device 100 according to an embodiment of the disclosure may prevent flames from going out even when the amount of gas supplied from the second orifice 132 is rapidly reduced. FIG. 11 illustrates a modified version of the gas burner device shown in FIGS. 9 and 10. Referring to FIG. 11, a modified embodiment of the gas burner device 100 will now be described. The same parts as those in FIGS. 9 to 10 will have the same reference numerals, and the detailed description thereof will not be repeated.

Referring to FIG. 11, a gas burner device 100 may further include a third chamber opening 129. The third chamber opening 129 may be formed when the second venturi tube 123 is mounted on the venturi guide 115. The third chamber opening 129 may be provided to link the branched chamber 126 to the outside.

When the gas is supplied from the second orifice 132, additional outside air may be supplied to the second burner 120 through the third chamber opening 129 and the second chamber opening 126*b* due to negative pressure caused by the venturi effect.

When the amount of gas supplied from the second orifice 132 is rapidly reduced, the gas and air moving from the venturi guide 115 to the second venturi tube 123 may be branched into the branched chamber 126 through the second chamber opening 126*b*, and the air and gas branched into the branched chamber 126 may be discharged to the outside through the third chamber opening 129 and the first chamber opening 126*a*.

With this structure, the gas burner device 100 shown in FIG. 11 may prevent flames from going out.

According to embodiments of the disclosure, a gas burner device and cooking apparatus having the same may have better efficiency by increasing the amount of supply of primary air.

According to embodiments of the disclosure, a gas burner device and cooking apparatus having the same may reduce the amount of primary air through a bypass flow path when the amount of gas supply decreases significantly, thereby maintaining stability of flames and thus preventing the flames from going out.

Although the present disclosure has been described with various embodiments, various changes and modifications may be suggested to one skilled in the art. It is intended that the present disclosure encompass such changes and modifications as fall within the scope of the appended claims.

What is claimed is:

1. A gas burner device comprising:

an orifice holder including an orifice; and a burner body including four venturi tubes arranged to receive a gas from the orifice, a burner port arranged to discharge the gas supplied through four venturi tubes, and four gas chambers arranged to guide the gas that passed the venturi tubes to the burner port, the gas chambers respectively corresponding to the venturi tubes and partitioned from each other, wherein each of the venturi tubes comprises:

a venturi inlet through which the gas that is jetted from the orifice flows in, a venturi outlet through which the gas flowing in through the venturi inlet is discharged, and an acceleration part including a smaller inner diameter than the venturi inlet and the venturi outlet, wherein the smaller inner diameter is constant along a length of the acceleration part such that the acceleration part has a cylindrical shape, wherein each of the gas chambers has a shape of a sector of a circle, and the shape of the sector of the circle includes an arc of the circle corresponding to an outer circumferential surface of the burner body on which the burner port is arranged, and a guide wall configured to guide the gas discharged from the venturi outlet toward the burner port, wherein each of the gas chambers gradually expands as it extends from a portion closest to a center of the burner body to the burner port, wherein the guide wall has a substantially constant height along its entire length such that a top surface of the guide wall is substantially planar, and wherein the venturi outlet is spaced apart from the guide wall and the burner port, and the venturi outlet is arranged closer to a center of the respective gas chamber than to the arc of the respective gas chamber.

2. The gas burner device of claim 1, wherein the acceleration part is located closer to the venturi inlet than to the venturi outlet.

3. The gas burner device of claim 1, wherein at least one of the venturi tubes comprises a diffuser located between the acceleration part and the venturi outlet.

4. The gas burner device of claim 3, wherein the diffuser is longer than the acceleration part.

5. The gas burner device of claim 1, wherein a bottom side of each of the gas chambers is located lower than a bottom surface of the burner port.

6. The gas burner device of claim 5, further comprising: a burner cap covering a top side of the burner body, wherein the burner cap comprises a guide projection configured to guide the gas discharged from the venturi outlet to the bottom side of the gas chamber.

7. The gas burner device of claim 1, wherein the burner port comprises a bead protruding at an end from which the gas is discharged and configured to guide the gas discharged upwards.

8. The gas burner device of claim 7, wherein the bead comprises a curved portion formed concave downwards.

* * * * *